US007507324B2

(12) United States Patent
Mazzara et al.

(10) Patent No.: US 7,507,324 B2
(45) Date of Patent: Mar. 24, 2009

(54) METHOD FOR ETCHING LAYERS DEPOSITED ON TRANSPARENT SUBSTRATES SUCH AS GLASS SUBSTRATE

(75) Inventors: Christophe Mazzara, Fresnes (FR); Nathalie El Khiati, Deuil la Barre (FR); Jaona Girard, Sevran (FR)

(73) Assignee: Saint-Gobain Glass France, Courbevoie (FR)

( * ) Notice: Subject to any disclaimer, the term of this patent is extended or adjusted under 35 U.S.C. 154(b) by 571 days.

(21) Appl. No.: 10/469,830

(22) PCT Filed: Feb. 27, 2002

(86) PCT No.: PCT/FR02/00706

§ 371 (c)(1),
(2), (4) Date: Feb. 12, 2004

(87) PCT Pub. No.: WO02/070792

PCT Pub. Date: Sep. 12, 2002

(65) Prior Publication Data

US 2004/0140227 A1 Jul. 22, 2004

(30) Foreign Application Priority Data

Mar. 7, 2001 (FR) ..... 01 03092

(51) Int. Cl.
*C25F 3/02* (2006.01)
*C25D 17/12* (2006.01)

(52) U.S. Cl. ..... 205/666; 205/668; 204/280

(58) Field of Classification Search ..... None
See application file for complete search history.

(56) References Cited

U.S. PATENT DOCUMENTS

| | | | | |
|---|---|---|---|---|
| 4,424,433 | A * | 1/1984 | Inoue | 205/148 |
| 5,567,304 | A | 10/1996 | Datta et al. | |
| 6,544,391 | B1 * | 4/2003 | Peace | 204/198 |
| 2002/0153246 | A1 * | 10/2002 | Wang | 204/297.01 |

FOREIGN PATENT DOCUMENTS

| | | | |
|---|---|---|---|
| FR | 2 325 084 | | 4/1977 |
| FR | 2325084 | * | 4/1977 |

* cited by examiner

*Primary Examiner*—Harry D. Wilkins, III
*Assistant Examiner*—Nicholas A. Smith
(74) *Attorney, Agent, or Firm*—Oblon, Spivak, McClelland, Maier & Neustadt, P.C.

(57) ABSTRACT

A process for electrochemically etching a layer with electric conduction properties, of the doped metal oxide type, on a transparent substrate of the glass type, fitted with a mask capable of being removed after etching. The process brings at least one region to be etched of the layer into contact with an electrically conducting solution, immerses an electrode in the solution and places the electrode facing and at a distance from the region, and applies an electrical voltage between the electrode and the layer to be etched. The electrode has an oblong shape such that the etching is carried out on several regions of the layer over a width of the substrate.

13 Claims, 3 Drawing Sheets

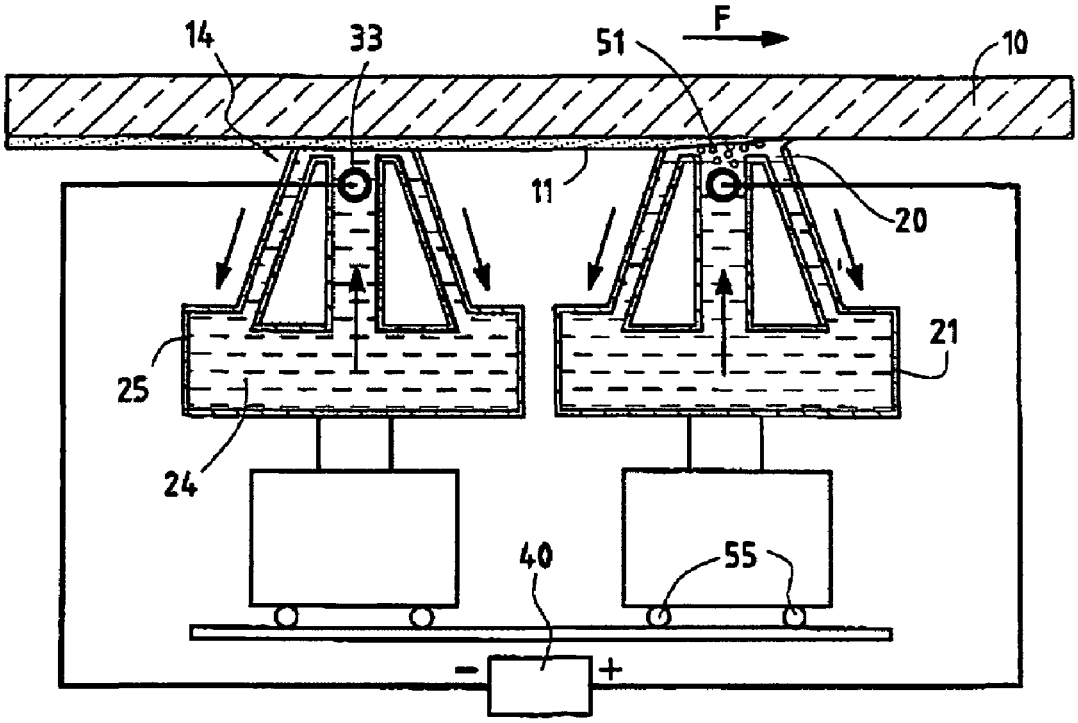
FIG.6B
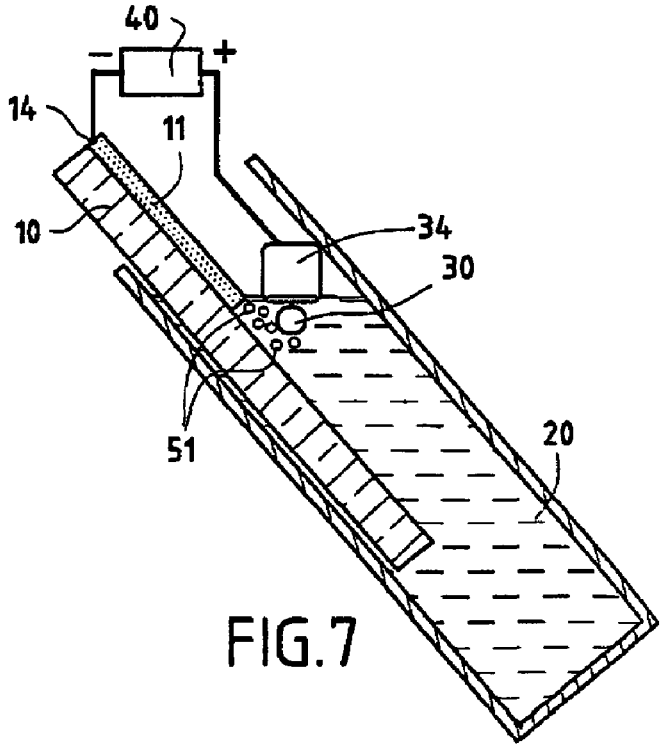
FIG.7
FIG.8
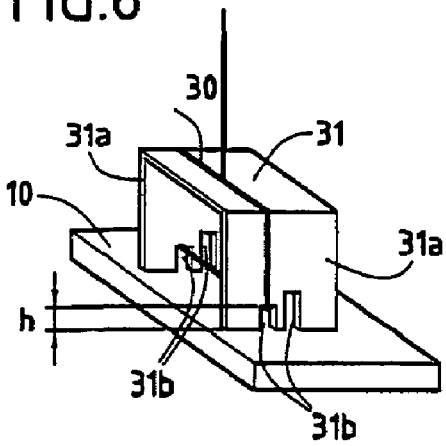

METHOD FOR ETCHING LAYERS DEPOSITED ON TRANSPARENT SUBSTRATES SUCH AS GLASS SUBSTRATE

The invention relates to a process for etching layers, deposited on transparent substrates of the glass substrate type and more particularly layers which are at least slightly electrically conducting for the purpose of obtaining electrodes, conducting elements.

The invention is especially advantageous for layers based on a metal oxide of the fluorine-doped $SnO_2$ type which are generally used as electrodes for emissive screens of the flat screen type, for example plasma screens.

U.S. Pat. No. 3,837,944 discloses a technique for chemically etching layers of conducting metal oxide such as $SnO_2$, consisting first of all in depositing on the layer to be etched a continuous resin-based layer called a "photoresist" which it is necessary to irradiate through a negative, develop then rinse so as to obtain a mask having the desired pattern. Next, dried zinc powder is deposited on the layer provided with the mask and the regions of the layer which are not covered by the resin are then chemically etched by dipping the substrate into a bath of strong acid of the HCl type.

Etching by chemical means is well suited to ITO but proves to be not very effective for $SnO_2$ or even fluorine-doped $SnO_2$ ($F:SnO_2$) which are more resistant.

French patent application FR 2 325 084 discloses another process, by electrochemical means. This involves electrolytically reducing the metal oxide layer $SnO_2$ by dipping the substrate provided with the layer to be etched and a copper electrode into a bath of a hydrochloric acid or sulfuric acid solution, the substrate and the electrode being connected to an electrical power supply in order to form the cathode and the anode, respectively, of the system. The electrode is slowly immersed at constant speed, for example at about 1 cm/min for a layer thickness of 0.5 μm.

The principle of etching by electrochemical means is advantageous, however, the process described above with an electrode of this type, may lead to a problem of overetching.

FIG. 2 illustrates the phenomenon of overetching. The substrate is immersed at constant speed, the etching therefore takes place progressively with the advance of the substrate. Since the substrate remains immersed, the regions already etched remain in contact with the electrolytic solution and facing the electrode such that the etching continues on these regions, passing under the mask. This part of the layer under the mask, which is therefore removed, is called overetching which, if it is nonuniform, then makes the substrate unusable since the distance between the electrodes of the etched substrate is no longer constant.

The aim of the invention is therefore to propose a new type of process, using electrochemical etching, which considerably limits, and even prevents, the overetching phenomenon.

According to the invention, the process for electrochemically etching a layer with the electrical conduction properties, of the doped metal oxide type, on a transparent substrate of the glass type, the substrate comprising, deposited on said layer prior to the process, a mask with patterns delimiting a plurality of bared regions on the layer, the mask being capable of being removed after etching, and the process consisting in:

- bringing at least one region to be etched of the layer into contact with an electrically conducting solution,
- immersing an electrode in the solution and in placing it facing and at a distance (d) from the region,
- applying an electrical voltage between the electrode and the layer to be etched, is characterized in that it uses at least one electrode and the electrode has an oblong shape such that the etching is carried out on several regions of the layer over a width l.

An oblong electrode shape, that is to say one having a cross section of dimensions much less than its length, enables the substrate to face the electrode only over a limited area and not over its entire surface and therefore facing regions already etched. The risk of overetching is then considerably limited.

In order to completely eliminate this risk, the process of the invention intends that the electrode or the substrate be moved one with respect to the other so that the electrode is positioned successively facing regions to be etched simultaneously and that, according to a first embodiment, the regions already etched be physically isolated from the electrically conducting solution or, according to a second embodiment, the etch rate be decreased as the regions are gradually etched and remain in contact with the electrically conducting solution.

According to the first embodiment, the electrode is held fixed in the conducting solution which is temporarily brought into contact only with the regions to be etched simultaneously, the time of the etching. To this end, as a first variant, the conducting solution is in a fixed position while the substrate is moved at constant speed with respect to the solution, or else the substrate is in a fixed position while the solution is moved at a constant speed with respect to the substrate. Also, according to one characteristic, the conducting solution is contained in a tank adjusted to the dimensions of the electrode and placed under the substrate.

As a second variant of the first embodiment, the substrate is immersed in the conducting solution for the etching and dipped, after etching, into a nonconducting second solution over which the conducting solution stays suspended.

According to a third variant of the first embodiment, the substrate is completely immersed in a fixed manner in the solution, the face endowed with the layer being parallel to and facing the surface of the solution, and the electrode is moved at a constant speed facing the regions to be etched and is combined with coating means which coat the electrode and the regions to be etched in order to isolate them from the etched regions.

According to the second embodiment of the invention, the electrode is fixed in the conducting solution while the substrate is progressively immersed in the solution as the etching gradually takes place, the etch rate being decreased by decreasing the speed of movement of the substrate. Advantageously, the speed of movement of the substrate is a decreasing exponential function.

When all the regions to be etched constitute a plurality of strips substantially parallel to each other, the electrode is placed transversely to the strips.

Preferably, the layer placed on the substrate is metallic tin oxide or metallic fluorine-doped tin oxide.

The electrode is preferably made of platinum and has a cross section of between 0.2 and 5 $mm^2$.

According to another characteristic, the substrate is provided with an electric contact in order to apply the electric voltage, the contact being arranged at one end of the substrate, and the etching is carried out from the end free of any electric contact up to the opposite edge provided with the electric contact. The electric voltage is at least equal to the reduction potential of the conducting material constituting the layer. As a variant, the voltage between the electrode and the layer is applied by means of an electric contact obtained by immersing an electrode in an electrically conducting solution brought into contact with at least one unetched region.

Advantageously, means are provided for detaching oxygen and hydrogen bubbles which appear during etching close to and/or on the electrode.

Also, the invention equally deals with a transparent substrate comprising a layer with electric conduction properties etched by the process explained above.

In particular, it will be possible to use this type of substrate in display screens of the plasma screen type.

The substrate may advantageously consist of a glass composition having a strain point (lower annealing temperature) greater than 540° C., the contraction value of the substrate being less than 60 ppm, and its thermal performance DT being greater than 130° C.

Other advantageous and characteristics of the invention will become apparent on reading the following description with regard to the appended drawings in which:

FIGS. 1*a* and 1*b* show a substrate respectively before and after the etching process;

Figure 4:
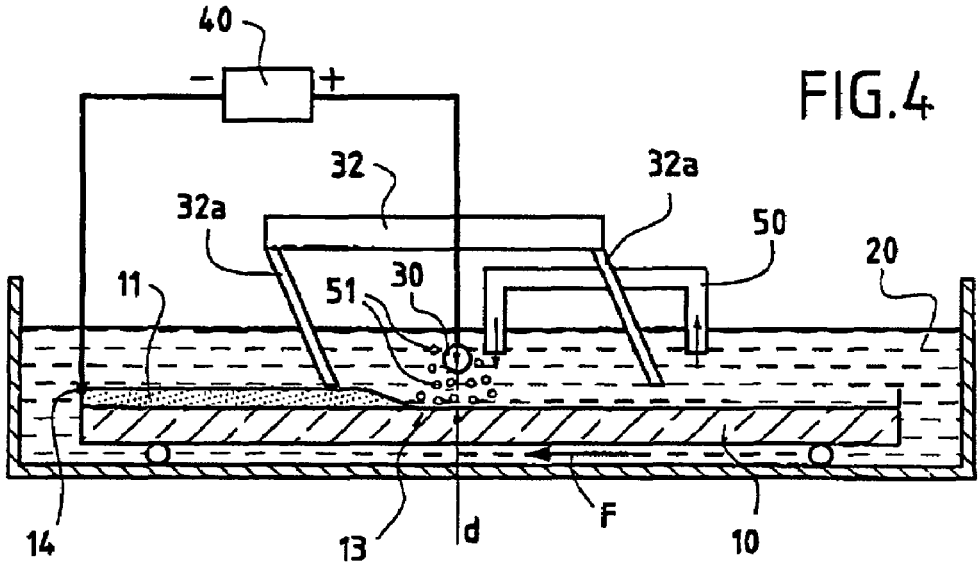

FIGS. 4,5,6*a*, 6*b* and 7 are schematic views in section of variants of the process of embodying the invention;

FIG. 8 is a profile view of the electrode associated with a support as for the variant of FIG. 4.

The figures are not produced to scale in order to simplify their understanding.

Figure 1A:
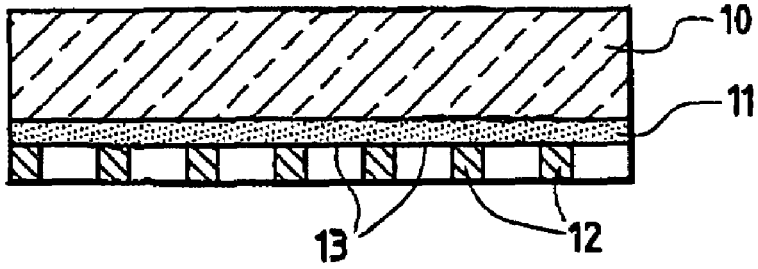
Figure 1B:
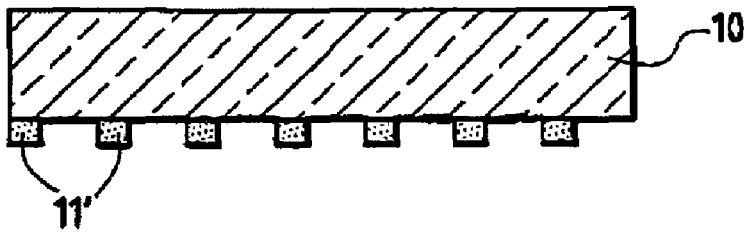

It is appropriate to take by way of example in the rest of the description a transparent substrate 10 of glass type which is illustrated in FIGS. 1*a* and 1*b* respectively before and after having undergone the etching process of the invention.

The substrate 10 is made of float glass with a thickness of about 2.8 mm, and in this case, by way of example, of dimensions 60 cm×100 cm, it is designed to form a front or rear face of an emissive screen of the plasma screen type.

The substrate 10 comprises a layer 11 of fluorine-doped tin oxide ($F:SnO_2$) with a thickness of 300 nm, for example deposited in a prior step which is not described here in detail, since it is known to a person skilled in the art, either by a technique of the chemical vapor deposition type directly and continuously onto the float glass ribbon or in a subsequent step, onto the cut glass, or by a vacuum technique generally in a subsequent step, onto the cut glass.

The aim is to obtain a high resolution etching of the layer in order to provide electrodes 11' in the form of parallel strips 100 cm long, a dimension corresponding to the length of the substrate, and 250 μm wide. These strips may be grouped in "pairs" of bands spaced one from the other by 400 μm, with a distance between two strips of the same pair of 80 μm.

A resin-based mask 12, called a "photoresist", whose thickness may vary from 3 to 60 μm, covers the entire layer 11 for the purpose of etching.

The process of depositing the mask, well known to a person skilled in the art and an embodiment of which is, for example, described in U.S. Pat. No. 3,837,944, will not be explained hereinbelow.

The mask 12 has a pattern which forms the strip shape of the electrodes 11' to be obtained. Also, the layer 11 is etched onto the bared regions 13 without a mask, which overall also constitute parallel strips.

The etching process of the invention consists in bringing the regions 13 to be etched into contact with a conducting solution, or electrolyte, in immersing an electrode in the same solution, in placing it facing each region 13 and in applying an electric voltage between the electrode and the layer 11.

Figure 3:
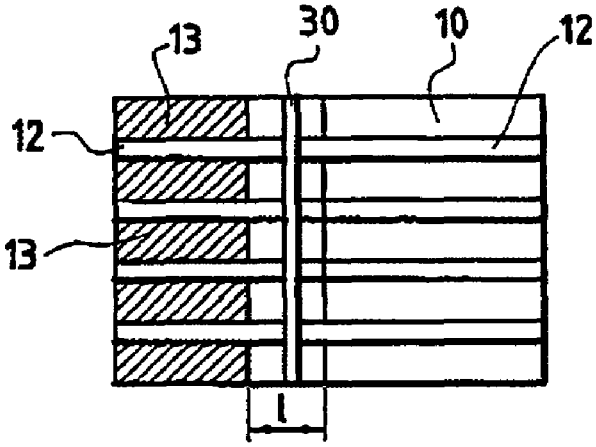
FIG. 3 is a top view of the substrate provided with the mask, part of the layer of which is etched.

The electrode is of oblong shape in order preferably to extend over the entire width of the substrate and transversely to the strips to be etched, which makes it possible to cover several regions 13 which will thus be able to be etched simultaneously (FIG. 3). The etching is carried out over a surface of width l, of about 1 cm for example, and perpendicular to the axis of the electrode. The etching operation is reiterated by moving either the electrode, or the substrate, transversely to the strips to be etched and over the entire length of the substrate.

If it is not possible for the electrode to be as large as the width of the substrate, the etching operation is carried out over a length corresponding to the length of the electrode and the operation must then be repeated in order to etch the substrate over its entire length. Alternatively, in order to save on production time, it is possible to envision using several electrodes, each of which etches a portion of the width of the substrate.

The etching is produced by an electrochemical reaction: the ions of the solution transport the electrons which etch the $SnO_2$ layer in order to reduce it to the metal state (Sn) and to generate oxygen and hydrogen which appear as bubbles 51 around the region 13 (FIGS. 4 to 7). Means 50 for detaching these bubbles (FIG. 4), such as ultrasound, may be used in order to prevent a bubble attaching itself to the $F:SnO_2$ layer thereby preventing or minimizing the etching which otherwise would cause a short circuit.

The process of the invention therefore consists in displacing the electrode or the substrate one with respect to the other so that the electrode is positioned successively facing the regions to be etched simultaneously and that, according to a first embodiment, the regions already etched are physically isolated from the electrically conducting solution, or according to a second embodiment, the etch rate is decreased as the regions are gradually etched and remain in contact with the electrically conducting solution.

FIGS. 4 to 6*a* and 6*b* illustrate variants of the device for implementing the process according to the first embodiment, while FIG. 7 illustrates the implementational device according to the second embodiment. Common elements are indicated by identical references.

The conducting solution 20 consists of a bath which may or may not contain all the substrate, at least the region to be etched having to be in contact with the solution. For example, hydrochloric acid (HCl) whose concentration is from 0.1 to 5M, preferably about 1M, is chosen.

The electrode is therefore of oblong shape, that is to say that its cross section, whatever its shape, is smaller in dimensions than its length. The electrode may, for example, be an electrically conducting wire, advantageously made of platinum, whose diameter corresponds to the cross section s placed facing the regions 13. As a variant, it may be a flat parallelepipedal conducting element, such as a rigid metal sheet whose thickness corresponds substantially to the cross section s placed facing the regions 13.

The diameter of the cross section s of the electrode is, for example, equal to 0.5 mm but could be larger or smaller. The size is to be adapted according to the type of electrode chosen, for example for a wire, it depends on the length of the wire and on its material in order to provide a degree of rigidity. The cross section will advantageously be between 0.2 and 5 $mm^2$.

The distance d which separates the electrode from the layer to be etched is defined as being the smallest distance separating the electrode from the layer, that is to say at the perpendicular to the plane of the substrate. It may vary from 0.1 mm to 3 cm for the type of substrate taken here as an example, however it is especially dictated by the desired width and depth of the region to be etched and by the cross section s of the electrode.

An electric contact 14 is provided connected to the layer 11 and in a fixed manner at one of the ends of the substrate, it is connected to the negative terminal of a voltage generator 40 while the electrode 30 is connected to the positive terminal. As has been seen, the etching is carried out transversely to the parallel strips of the layer 11 to be etched, in addition, it advantageously starts at the end of the substrate free from any electric contact to finish at the end intended for the contact 14 so as to provide a constant electric connection of the regions remaining to be etched, only one movement of the electrode with respect to the substrate or conversely proves to be necessary.

As a variant, in order to avoid fixing an electric contact of this type on the substrate, it is possible to envision a contact made action with the conducting solution by capillary action, as described below with regard to FIG. 6*b*.

The electric voltage U provided by the generator 40 and applied between the electrode 30 and the layer 11 must be, at a minimum, equal to the reduction potential of the metal or of the metal oxide of the layer; for $SnO_2$, the minimum voltage is 2 V. It is possible to envision applying a voltage up to a few hundred volts. The current supplied by this same generator may, for example, be 3A.

Finally, the etching time during which the electrode 30 stays in position facing the region 13 to be etched and during which the voltage is applied, may vary from a few seconds to a few minutes for the type of substrate taken here as an example. Here again, the time depends on the various parameters involved in the process and mentioned above, and especially on the distance d and on the thickness of the region to be etched, that is to say on the thickness of the layer 11.

Thus, the various parameters involved in the process for etching a region of given width and thickness, which are the concentration of the solution, the current, the distance d, the cross section s of the electrode, and the etching time depend on each other and must, consequently, be adjusted with respect to each other.

In the first variant of the first embodiment visible in FIG. 4 and illustrating a sectional view in a plane parallel to and passing through a strip of the substrate without mask and therefore to be etched, the substrate 10 is completely immersed horizontally in the solution 20 and held fixed, the face provided with the layer 11 and the mask 12 being turned toward the surface of the solution. The etching is carried out by moving the electrode 30 in a translational movement F at constant speed.

The layer 11 is connected by one of the ends of the substrate via the electric contact 14 to the negative pole of the generator 40 while the positive pole of the latter is connected to the electrode 30.

The electrode 30 consisting of a platinum wire is arranged transversely to the strips to be etched and the wire is positioned to the vertical of the region 13 to be etched.

Figure 2:
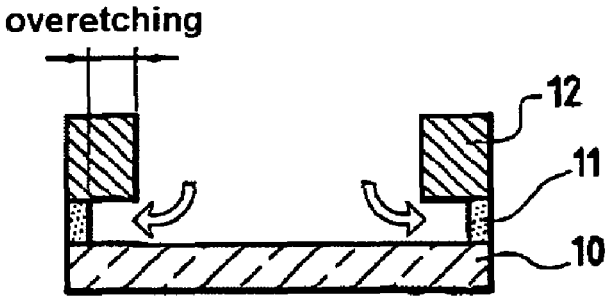
FIG. 2 illustrates the overetching phenomenon.

The electrode is kept in a fixed position during etching by virtue of support means 31 which are not visible in FIG. 2 but illustrated in FIG. 8. This involves a U-shaped frame, which is isolating and capable of chemically withstanding the conducting solution 20, for example made of PVC, around which the platinum wire is tightened. The leads 31*a* of the U-shaped frame bear on the substrate, and the wire 30 is kept at the distance d from the substrate by its engagement in two notches 31*b* placed face to face on the leads 31*a* of the U-shaped clip, the height h of the notches corresponding to the distance d. Several notches 31*b*, of different heights, may be provided, so as to provide different possible distances d.

In order to completely avoid overetching the regions already etched, the region in the process of etching is physically isolated by surrounding the electrode and the region with covering means 32 such as a flexible skirt. The skirt is designed to surround the electrode 30, its sections 32*a* being flush with the layer 11 without scratching it and falling on each side of the regions 13 being etched.

Finally, rather than using ultrasound as a means of detaching the hydrogen and oxygen bubbles, a more "gentle" etching of the layer is envisioned by installing a closed circulation of the conducting solution by virtue of a lift-and-force pump 50, for example, which sucks liquid from the solution by one end and ejects it by the other end above the region 13 in the process of being etched so as to drive out the bubbles.

Figure 5:
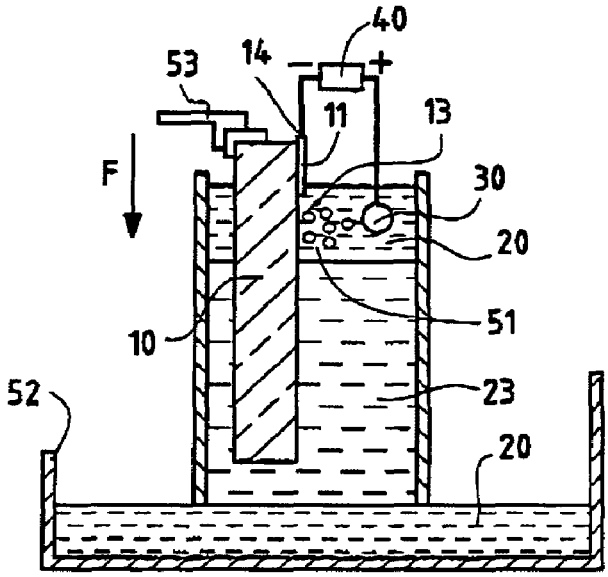

In the second variant of the first embodiment illustrated in FIG. 5, the electrode 30 stays in a fixed position in the electrically conducting solution 20 while the substrate 10 is immersed vertically along the displacement F and at constant speed into the solution by displacement means 53 such as a clamp manipulated by a mechanical arm.

The electrically conducting solution 20 stays suspended over a nonconducting solution 23. The height of the solution 20 corresponds at least to the width 1 of the etching (FIG. 2) of a strip 13 to be etched and the height of the nonconducting solution 23 is substantially equal to the size of the substrate. A tank 52 accommodates the solutions 20 and 23 so as to receive the overflow of the solution 20 during immersion of the substrate.

Thus, after the substrate has passed into the solution 20 for etching, it is introduced into the solution 23, which is nonconducting, immediately stopping the etching. Any risk of overetching is removed.

In the third embodiment (FIGS. 6*a* and 6*b*), the electrode 30 is held fixed in the conducting solution 20 which is temporarily brought into contact with only the regions 13 to be etched simultaneously, the etching time.

In order to achieve this, the electrode 30 remains dipped in a tank 21 which contains the solution 20 and is adapted just to the size of the electrode. The regions to be etched of the substrate are then brought into contact with the solution by capillary action, the electrode facing these regions.

The regions to be etched are successively brought into contact either by moving the substrate with respect to the tank 21 remaining in a fixed position, it being possible for the substrate to pass by at constant speed above the tank 21 by suitable driving means 54, or by moving the tank 21 with regard to the substrate remaining in a fixed position, the tank 21 passing by at constant speed by means of suitable driving means 55 and below the substrate held in position by suspension means.

So that the solution 20 is always in contact with the substrate, one of the two elements continuously moving, overpressure means (not illustrated) are provided in order to obtain a minibubbling or permanent overflow state of the solution 20.

Thus, the conducting solution 20 containing the electrode 30 is in contact with the regions 13 to be etched simultaneously only for the etching, and once the regions are etched, they are no longer in contact with the solution, necessarily avoiding the overetching phenomenon.

Optionally, any residues of the conducting solution may then be rinsed from the etched surface of the substrate by bringing the etched regions of the substrate into contact with another tank 22 filled with water. This tank is fixed if the substrate moves or is mobile if the substrate remains fixed.

In this device, it is quite possible to use as a type of electrode, not a wire, but for example a metalized support, the support being structurally integrated into the tank 21 and forming a channel in which metal placed facing the substrate is housed.

Figure 6A:
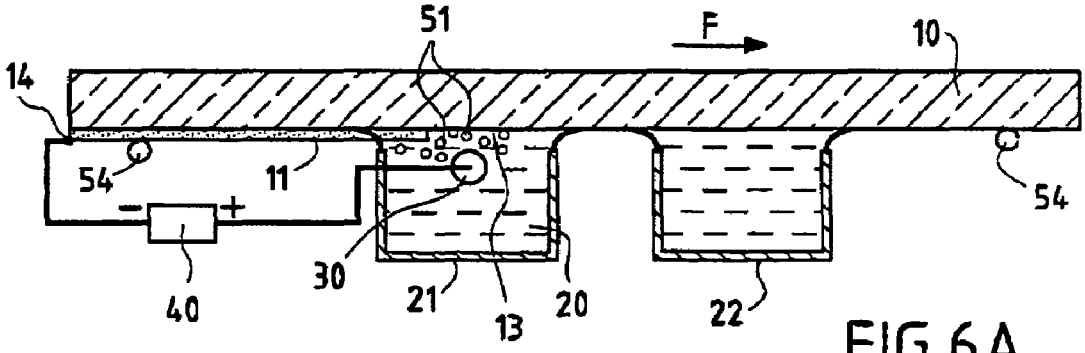

In FIG. 6*a*, the electric contact 14 is fixed to one; of the ends of the substrate, the etching operation being carried out, as already explained above, from the free end of the substrate toward the end which is electrically connected.

In FIG. 6*b*, an electric contact 14 which is physically independent of the substrate, is preferred, which consists of an electrode 33 dipped into an electrically conducting solution 24 contained in a tank 25, the solution 24 being brought into contact with at least one as yet unetched region of the substrate. Also, the tank 25 is separated by a constant distance from the equivalent tank 21 and by a distance proportional to at least one distance separating two parallel strips of the layer 11.

In the device for implementing the process according to the second embodiment (FIG. 7), the electrode 30 remains in a fixed position while the substrate 10 is dipped, vertically or obliquely, progressively into the solution 20 according to a translational movement F in order to etch the regions 13.

The electrode 30 consisting of the platinum wire is secured to a float 34 which is able to slide in a guide parallel to the translational movement of the substrate. The float makes it possible to keep the electrode/substrate distance d constant as a result of increasing the level of the solution with the progressive introduction of the substrate. Again, in this case, the float is a means taken by way of example to keep the electrode/substrate distance d fixed. Moreover, it is possible to provide a collection tank on account of the overflow of the solution by progressive introduction of the substrate.

The substrate 10 keeps a fixed position during the etching time, the regions 13 to be etched being placed facing the wire 30. The substrate is moved by means of moving support means which are not visible in the figure. The two edges of the substrate lateral to the strips to be etched are combined with the support means which are able to slide in guide rails lying in the direction of translation of the substrate.

The electric contact 14 of the substrate is located at the upper end of the substrate which emerges from the solution 20 so that the electric connection is permanent during the etching.

In order to ensure that the overetching phenomenon does not occur in spite of limiting the regions placed facing the electrode, the etch rate is increased during immersion. In order to do this, the immersion speed of the substrate is decreased, preferably according to a function of the decreasing exponential type.

After the layer 11 has been etched over all of the regions 13, according to any one of the embodiments and variants explained above, the mask is removed, a step well known to a person skilled in the art, either by chemical means by dissolving it in a suitable solvent, or by a heat treatment, a hot air knife being blown over the mask or the substrate being passed through a furnace.

The etching process described above is particularly suitable for etching $SnO_2$, but of course, it can be applied to all types of metals or metal oxides such as ITO, which are conductive or not very conductive.

The invention claimed is:

1. A process for electrochemically etching a layer with electric conduction properties, of doped metal oxide type, on a transparent substrate of glass type, the substrate including, deposited on the layer prior to the process, a mask with patterns delimiting a plurality of bared regions on the layer, the mask being capable of being removed after etching, the process comprising:

bringing at least one region to be etched of the layer into contact with an electrically conducting solution;

immersing a first electrode in the solution and placing the first electrode facing and at a distance from the at least one region;

applying an electrical voltage between the first electrode and the layer to be etched with an electrical contact obtained by immersing a second electrode into the electrically conducting solution brought into contact with at least one unetched region, wherein the second electrode is separated from the layer; and physically isolating regions of the substrate already etched from the electrically conducting solution while etching continues on other unetched regions of the substrate.

2. The process as claimed in claim 1, wherein the substrate or the first electrode is moved one with respect to the other and one being fixed such that the first electrode is positioned successively facing regions to be etched simultaneously.

3. The process as claimed in claim 2, wherein the first electrode is held fixed in the conducting solution, which is temporarily brought into contact only with the regions to be etched simultaneously, at a time of the etching.

4. The process as claimed in claim 3, wherein the conducting solution is in a fixed position while the substrate is moved at a constant speed with respect to the solution.

5. The process as claimed in claim 3, wherein the substrate is in a fixed position while the solution is moved at a constant speed with respect to the substrate.

6. The process as claimed in claim 3, wherein the conducting solution is contained in a tank adjusted to dimensions of the first electrode and placed under the substrate.

7. The process as claimed in claim 1, wherein the first electrode is made of platinum.

8. The process as claimed in claim 1, wherein the first electrode has a cross section of between 0.2 and 5 $mm^2$.

9. The process as claimed in claim 1, wherein a distance separating the at least one region from the first electrode is between 0.1 and 30 mm.

10. The process as claimed in claim 1, wherein all the regions to be etched constitute a plurality of strips substantially parallel to each other.

11. The process as claimed in claim 10, wherein the first electrode is placed transversely to the plurality of strips.

12. The process as claimed in claim 1, wherein the electric voltage is at least equal to a reduction potential of the conducting material constituting the layer.

13. The process as claimed in claim 1, further comprising detaching oxygen and hydrogen bubbles appearing during etching close to or on the electrode.

* * * * *